US009458647B2

(12) United States Patent
Gartner

(10) Patent No.: US 9,458,647 B2
(45) Date of Patent: Oct. 4, 2016

(54) ROTARY BLOCKING DEVICE

(71) Applicant: Klaus W. Gartner, Palos Verdes Estates, CA (US)

(72) Inventor: Klaus W. Gartner, Palos Verdes Estates, CA (US)

(73) Assignee: MG TECH CENTER BV H.O.D.N. LOCK TECHNOLOGY, Ulft (NL)

( * ) Notice: Subject to any disclaimer, the term of this patent is extended or adjusted under 35 U.S.C. 154(b) by 122 days.

(21) Appl. No.: 14/090,615

(22) Filed: Nov. 26, 2013

(65) Prior Publication Data

US 2015/0115629 A1 Apr. 30, 2015

Related U.S. Application Data

(60) Provisional application No. 61/896,907, filed on Oct. 29, 2013.

(51) Int. Cl.
*E05C 3/06* (2006.01)
*E05B 17/20* (2006.01)
(Continued)

(52) U.S. Cl.
CPC ..... *E05B 17/2092* (2013.01); *E05B 47/0607* (2013.01); *E05B 65/0075* (2013.01); *E05B 65/0082* (2013.01); *E05C 3/12* (2013.01); *E05B 17/20* (2013.01); *E05B 47/0001* (2013.01); *E05B 47/0005* (2013.01); *E05B 47/06* (2013.01); *E05B 63/0013* (2013.01); *E05B 2047/0093* (2013.01); *Y10T 292/1052* (2015.04)

(58) Field of Classification Search
CPC .. Y10S 292/61; E05B 47/0001; E05B 47/06; E05B 17/20; E05B 47/0607; E05B 63/0013; E05B 65/00
USPC ..... 292/201, 216, 219, 220, 202, 210, 292/341.16
See application file for complete search history.

(56) References Cited

U.S. PATENT DOCUMENTS 1,414,242 A * 4/1922 White ..... E05B 83/243 292/219
1,619,031 A * 3/1927 Ostrosky ..... E05C 3/046 292/210

(Continued)

FOREIGN PATENT DOCUMENTS

CN 101379257 A 3/2009
EP 2495379 A1 9/2012
FR 2922577 A1 * 4/2009 ..... E05B 45/06

OTHER PUBLICATIONS

International Search Report and Written Opinion, regarding corresponding patent application Serial No. PCT/US2014/012084, issued by the International Searching Authority United States Receiving Office; dated May 14, 2014; 7 pages.

(Continued)

*Primary Examiner* — Carlos Lugo
(74) *Attorney, Agent, or Firm* — Barbara A. Wrigley; Fox Rothschild LLP

(57) ABSTRACT

A lock including a housing having an opening for a locking bolt, a locking bolt movable between a locked position and an unlocked position, an actuator positioned within the housing, and a rotary blocking device that prevents the locking bolt from moving to the unlocked position. The lock may optionally include a tamper resistant mechanism that is designed such that attempting to forcibly move the locking bolt from the locked position to the unlocked position while the actuator remains in the locked condition causes the locking bolt to engage the tamper resistant mechanism.

7 Claims, 6 Drawing Sheets

(51) Int. Cl.

| | |
|---|---|
| ***E05B 65/00*** | (2006.01) |
| ***E05C 3/12*** | (2006.01) |
| *E05C 3/00* | (2006.01) |
| *E05B 47/06* | (2006.01) |
| *E05B 63/00* | (2006.01) |
| *E05B 47/00* | (2006.01) |

(56) References Cited

U.S. PATENT DOCUMENTS

| | | | | | |
|---|---|---|---|---|---|
| 2,169,535 | A * | 8/1939 | Marple | E05B 85/22 | 292/165 |
| 2,217,098 | A * | 10/1940 | Brownne | E05C 3/24 | 292/198 |
| 3,371,948 | A * | 3/1968 | Velavicius | E05B 85/243 | 292/216 |
| 3,504,511 | A * | 4/1970 | Allen | E05B 47/0607 | 292/201 |
| 3,890,813 | A * | 6/1975 | Cothron | 70/92 | |
| 5,134,870 | A * | 8/1992 | Uyeda et al. | 70/277 | |
| 5,142,890 | A * | 9/1992 | Uyeda et al. | 70/277 | |
| 5,473,922 | A * | 12/1995 | Bair et al. | 70/416 | |
| 5,498,040 | A * | 3/1996 | Silye | 292/201 | |
| 5,735,559 | A * | 4/1998 | Frolov | E05B 47/0047 | 292/210 |
| 6,209,932 | B1 * | 4/2001 | Jung et al. | 292/216 | |
| 6,786,519 | B2 * | 9/2004 | Gartner | 292/195 | |
| 7,090,264 | B2 * | 8/2006 | Dzurko | E05B 85/243 | 292/201 |
| 7,461,872 | B2 * | 12/2008 | Moon et al. | 292/209 | |
| 7,770,944 | B2 * | 8/2010 | Yuan | 292/195 | |
| 8,261,586 | B2 * | 9/2012 | Gartner | 70/277 | |
| 8,826,709 | B2 * | 9/2014 | Dehaven et al. | 70/416 | |
| 2008/0073916 | A1 * | 3/2008 | Min | 292/201 | |
| 2008/0276672 | A1 | 11/2008 | Gartner | | |

OTHER PUBLICATIONS

Chinese Office Action issued by the State Intellectual Property Office of P.R. China, regarding corresponding patent application Serial No. CN 201480005516.3; dated Mar. 22, 2016; 7 pages; P.R. China.

* cited by examiner

ROTARY BLOCKING DEVICE

CROSS REFERENCE TO RELATED APPLICATIONS

This application claims priority to U.S. provisional patent application Ser. No. 61/896,907, filed Oct. 29, 2013, the entirety of which is herein incorporated by reference.

BACKGROUND OF THE INVENTION

1. Field of the Invention

The present invention relates to locks having a rotary blocking device that prevents a bolt from moving to an unlocked condition and an optional tamper resistant mechanism that prevents unauthorized access to a safe when using force.

2. Description of the Related Art

Doors of safes, vaults, strong rooms, container and similar security closures (collectively called "safes" in this application) usually have at least one and preferably several safe bolts that reciprocate from a non-locking position to an extended locking position. In the locking position, the safe bolts extend from the safe door into the adjacent safe walls. When the safe has more than one bolt, bolt works connect the bolts. The bolt works include linkages that move the safe bolts simultaneously when a user turns a handle. A locking device cooperates with the bolt works to secure the safe bolts in their extended locking position.

Swing bolt or rotary bolt locking devices mount a bolt for pivoting between locked and unlocked positions. This application refers to the swing bolt within the locking device as the "bolt," "swing bolt," or "locking bolt." The bolts that secure the safe door to the rest of the safe are called "safe bolts." In the locked position, part of the locking bolt projects out of the housing and interferes with a portion of the mechanical bolt works, thereby preventing the bolt works from moving the safe bolts to the unlocked position. When the user enters the correct combination, the lock mechanism allows the locking bolt to pivot to the unlocked position within the housing, thus allowing the user to open the safe door.

Rectilinear bolt locking devices operate in a similar manner. In particular, rectilinear bolt locking devices mount a bolt within a housing for moving between locked and unlocked positions. Thus, instead of pivoting like rotary bolts, linear bolts slide into and out of the locking device housing. When the user enters the correct combination, the lock mechanism allows the locking bolt to slide into the housing. For purposes of explanation and example, the remainder of the background discussion will focus on rotary type locking devices.

In general, a handle on the outside of the safe connects to the bolt works. Rotating the handle initiates movement of the bolt works. If the user enters the correct combination which unlocks or releases the locking bolt, the bolt works can pivot the rotary bolt so that the rotary bolt does not project from the housing. This unlocked position permits the bolt works to continue moving the safe bolts to the unlocked condition, allowing the operator to open the safe. If, however, the rotary bolt is locked, the rotary bolt blocks movement of the bolt works, preventing the bolt works from withdrawing the safe bolts. U.S. Pat. Nos. 5,134,870 and 5,142,890 to Uyeda describe safes using rotary bolts.

The locking mechanism within the lock housing blocks the bolt from pivoting to the unlocked position. Uyeda utilizes a linear solenoid within the housing. Uyeda discloses a solenoid plunger that directly engages the locking bolt. Alternatively, the solenoid plunger engages a locking plate that projects against the bolt. When the plunger or plate engages the bolt, the bolt normally cannot rotate to an unlocked position.

An electronic combination entry system controls the solenoid. Typically, the user enters the combination through a digital input pad. U.S. Pat. No. 5,887,467 to Butterwerk, entitled "Pawl and Solenoid Locking Mechanism," is an example of a lock that uses an electronic key pad on a rotary handle. Rotary input through a dial also can generate an output. Internal circuitry senses entry of the correct combination and sends an electrical signal to the solenoid. The signal causes the solenoid to withdraw a plunger, which, in turn, allows the locking plate to disengage the locking bolt. The user rotates a handle which in turn manipulates the bolt works. Part of the bolt works pushes on the locking bolt to rotate the bolt about a shaft to the unlocked position. The bolt works then withdraws the safe bolts.

Applying sufficient force, such as pounding, jostling, twisting, vibration, or other manipulation, on a locked handle of a safe with a swing bolt lock that is engaged with a plunger controlled by a linear solenoid can sometimes open the safe. This results because the solenoid must be relatively small to fit within the lock housing correspondingly, the plunger is also small and weak. Consequently, sufficient force applied to the handle breaks the plunger. Once the plunger breaks, or is vibrated out of the way, the locking plate moves freely, which allows the swing bolt to pivot open. The bolt works can then be manipulated to withdraw the safe bolts to open the safe.

Uyeda and others have proposed a solution to this problem by using a "safety key" design. The bore of the swing bolt, which rotates about a shaft or axle, is elongated. The elongated opening can move along the bore when one applies a force from the handle through the bolt works on the swing bolt. Thus, the swing bolt can move laterally. Lateral movement causes a notch on the periphery of the swing bolt to engage a safety key in the lock housing. This prevents further force being applied to the swing bolt from transferring to the solenoid plunger or locking plate.

Uyeda also discloses a leaf spring that biases the swing bolt and the bore to a normal position relative to the shaft within the bore. When an unauthorized user tries to force the handle without first entering the correct combination, the notched bolt pushes against and engages the safety key in the housing preventing entry.

The mechanism disclosed by Uyeda is complex and costly to build and assemble. Others have simplified the mechanism, but the structure that biases the swing bolt relative to the shaft or axle remains complex. For example, one conventional swing bolt has a bolt plate mounted in a groove in the swing bolt. The plate has an opening over part of the elongated opening in the swing bolt. A spring within the bolt biases the opening in the plate to one end of the elongated opening. When force is applied to the bolt to cause it to pivot about the solenoid locking plate, the bolt plate slides on the bolt against the spring until the opening in the bolt plate is at the other end of the elongated opening in the swing bolt. This shifts the swing bolt sufficiently to cause the notch of the periphery of the swing bolt to engage the key in the lock housing. The construction of the swing bolt with the sliding plate and internal spring is complex. Assembly is time consuming and costs are high. Furthermore, since the spring is within the bolt, a bearing is created between the shaft and the lock housing instead of between the swing bolt and the shaft, thereby reducing the potential life cycle of the lock.

An alternative design of a lock assembly is disclosed in U.S. Pat. No. 6,786,519 to Gartner. Gartner discloses a solenoid mounted within a housing and a plunger on the solenoid that engages a locking plate. When the lock is in the locked condition, the locking plate engages the locking bolt, preventing the swing bolt from pivoting. When a user enters the correct combination, the plunger disengages the locking plate so that the latter is free to slide out of its engagement with the locking bolt. If an unauthorized user applies sufficient force to the handle through the bolt works against the swing bolt, the intersection of the swing bolt and the locking plate becomes an axis of rotation. The swing bolt rotates slightly on that axis because the opening in the swing bolt through which the shaft extends is elongated. The elongation permits some lateral movement of the swing bolt relative to the shaft. As a result, a single notch on the swing bolt periphery engages a safety key on the housing preventing access.

Unfortunately, safety key mechanisms such as the one disclosed in '519 to Gartner provide insufficient protection against unauthorized access into the safe. Notably, a thin piece of shim stock such as steel may be positioned between the single notch and the safety key when the locking bolt is in the locked position. When the locking bolt is forcibly rotated, the thin shim acts as a "camming" surface, allowing the single notch to bypass the safety key element. As a result, force from the swing bolt may once again be applied against the solenoid plunger or locking plate, potentially resulting in damage to the plunger or solenoid within the lock housing.

Solutions such as those disclosed by Gartner and Uyeda that utilize linear solenoids to control movement of a plunger into and out of a locking bolt or a locking plate provide insufficient protection against "shock." In the locked position, the plunger connected to the linear solenoid is extended such that it engages with, for example, a rotary locking bolt. In the unlocked position, the plunger retracts such that it no longer engages with the locking plate, thereby allowing the locking bolt to freely rotate. A problem arises when the linear solenoid, an electromagnetic device, receives a "shock." Shock can be a result of physical tampering, applied force, vibration, etc. Typically, when a linear solenoid receives a shock, it causes an extended shaft (or in this case, the plunger) to retract in reaction to the shock. This poses a problem because the retraction of the plunger without entering the correct combination would effectively allow unauthorized access into the safe despite the addition of a notch and safety key feature.

U.S. Pat. No. 8,261,586 to Gartner, the entirety of which is incorporated herein, addresses the foregoing issues related to insufficient protection against "shock." However, the lock disclosed in the '586 patent includes many piece parts, is expensive to make and difficult to assemble. For example, in order to block the rotary locking bolt the cam engagement means include both a D-shaped tab member and a stop member with radially extending flange. The locking bolt is blocked from underneath the bolt when the D-shaped tab member rotates to a flat portion and the bolt slides over the stop. Further, a compression spring couples a pin on the locking bolt to a pin on the housing which biases the bolt in the locked position.

Accordingly, there is a need for continued improvements in blocking devices for use with locks that simplifies the assembly by reducing the number of parts to be more cost-efficient, changes the method of blocking and can reliably block access under force and shock.

BRIEF SUMMARY OF THE INVENTION

The present invention solves the foregoing problems by providing a lock including a housing having an opening for a locking bolt, a locking bolt movable between a locked position and an unlocked position, and an actuator positioned within the housing. An optional tamper resistant mechanism in the housing is also provided. The actuator includes a locked condition engaging the locking bolt and an unlocked condition freeing the locking bolt to move to the unlocked position. The optional tamper resistant mechanism is designed such that attempting to forcibly move the locking bolt from the locked position to the unlocked position while the actuator remains in the locked condition causes the locking bolt to engage the tamper resistant mechanism.

In another aspect of the present invention, the actuator is operably coupled to a rotatable cam engagement means with a flange member for blocking the locking bolt. The flange member is configured to rotate between a first blocking position that blocks the locking bolt and a second position which allows the locking bolt to bypass it and unlocked position of the locking bolt. A cam return spring biases the rotatable cam engagement means in the first blocking position and a locking bolt return spring biases the locking bolt in the locked position

DETAILED DESCRIPTION OF THE INVENTION

Figure 1:
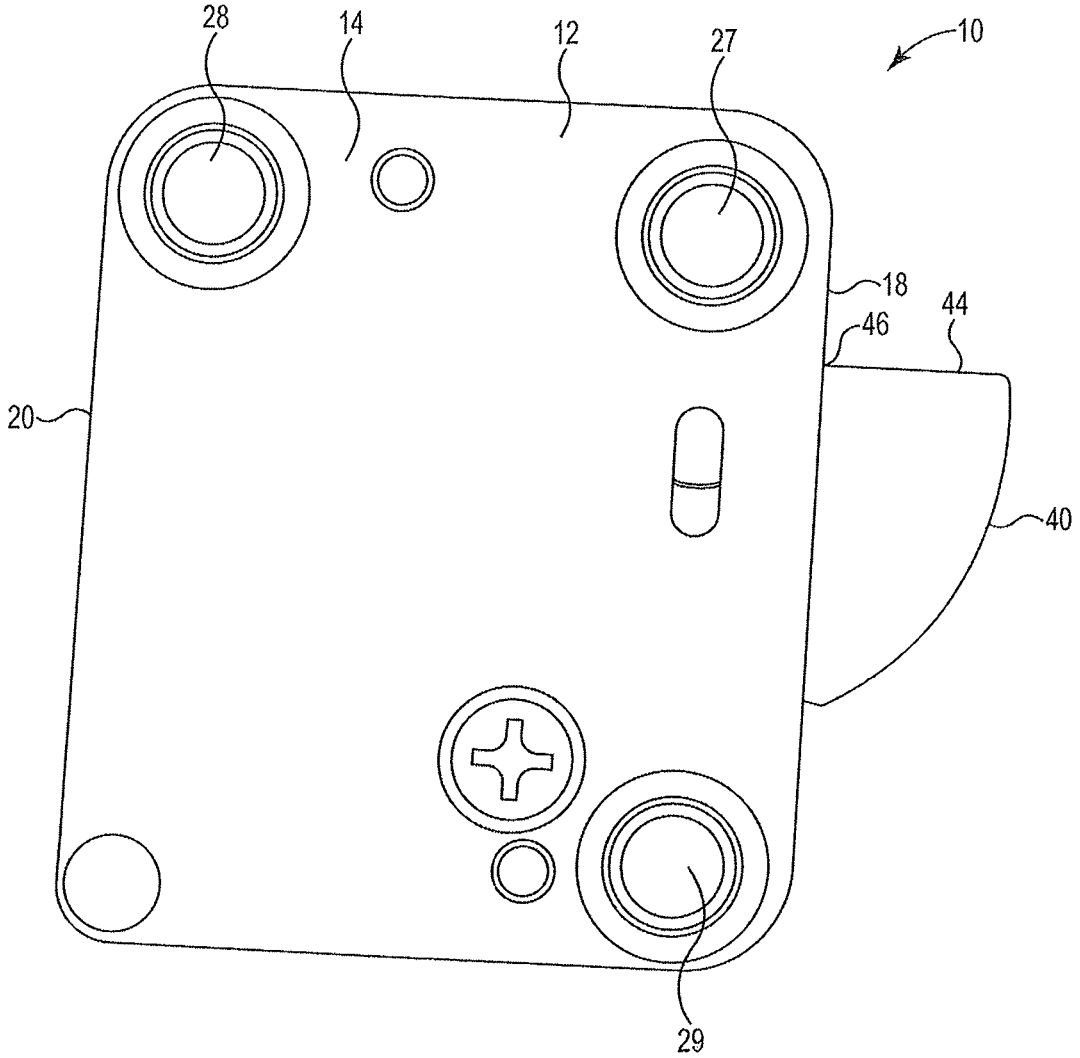
FIG. 1 is a top plan view of one embodiment of a lock according to the invention.
Figure 2:
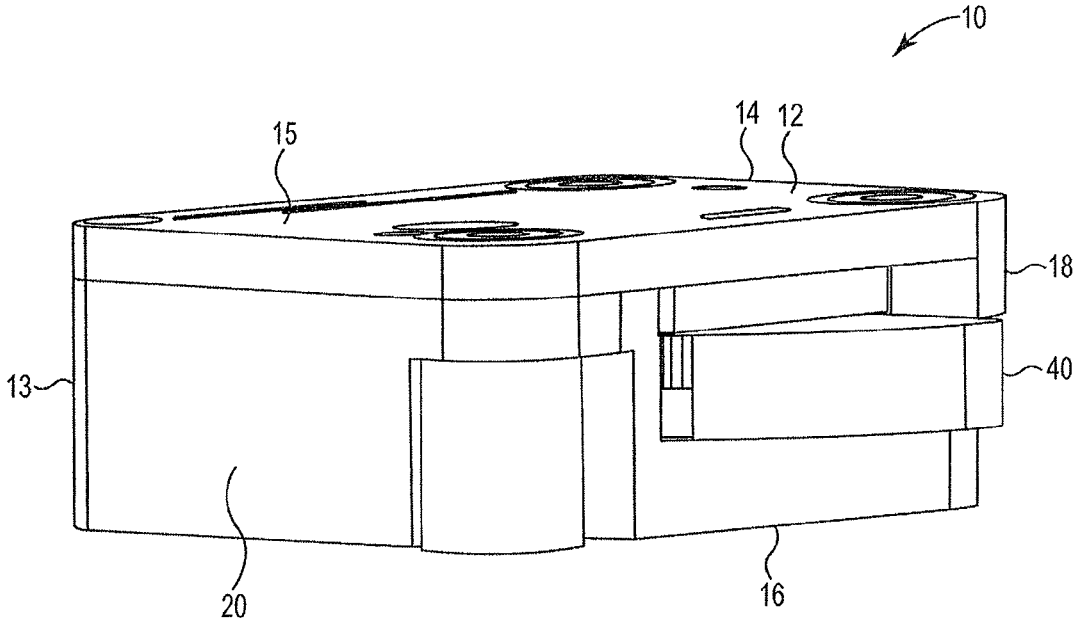
FIG. 2 is a side view of the lock depicted in FIG. 1.

FIG. 1 is a perspective view of one embodiment of the present invention, broadly including lock 10 including a housing 12 and a locking bolt 40 with an optional tamper resistant mechanism 95. Housing 12 is commonly brass or another reasonably hard, nonmagnetic metal that can be cast. Housing 12 has a top and bottom 14 and 16 and two sides 18 and 20. The use of "top," "bottom," and "sides" relates to the orientation of the lock in the figures. Each side could become a top or bottom depending on the orientation of the lock in the locked container. As FIG. 1 shows, housing 12 is may be rectangular with curved corners, a common, standard-shaped housing but as those of skill in the art may appreciate the shape of the housing may vary and still be within the scope of the invention.

Housing 12 includes base 13 having inside wall 24 and cover 15. Base 13 of housing 12 attaches to the door of a safe or other secure container. Cover 15 may be removable from housing 12 for repairing various components of lock 10. Cover 15 includes a plurality of openings 27, 28, 29 therethrough that receive a like number of fasteners that extend through openings and are threaded into threaded openings in the door of the safe. Thus, the fasteners secure lock 10 to a safe, a door or other type of container. The spacing and number of openings 27, 28, 29 is standardized by different safe manufacturers and vary from manufacturer to manufacturer and enable that manufacturers' locks to be compatible with various safes.

Referring now to FIGS. 1-4, a locking bolt 40 mounts in housing 12. In one embodiment, locking bolt 40 is a rotary bolt having a generally D-shape in cross-section. However, it should be understood that various other shapes of locking bolts 40 are contemplated and within the intended scope of the present invention. A shaft receiving opening 42 is positioned near the center of rotary bolt 40. Shaft receiving opening 42 is configured to receive a shaft or 43 that mounts within the housing. The shaft mounts in first and second sleeves (not shown) located on the inside top and bottom walls of the housing 12. Shaft receiving opening 42 is generally round and has a diameter that is slightly larger than the diameter of shaft 43. Shaft receiving opening 42 of locking bolt 40 fits onto the shaft 43, allowing locking bolt 40 to rotate about the shaft. Thus, a bearing means is formed between opening 42 of locking bolt 40 and shaft, which remains generally stationary as locking bolt 40 rotates.

Figure 3:
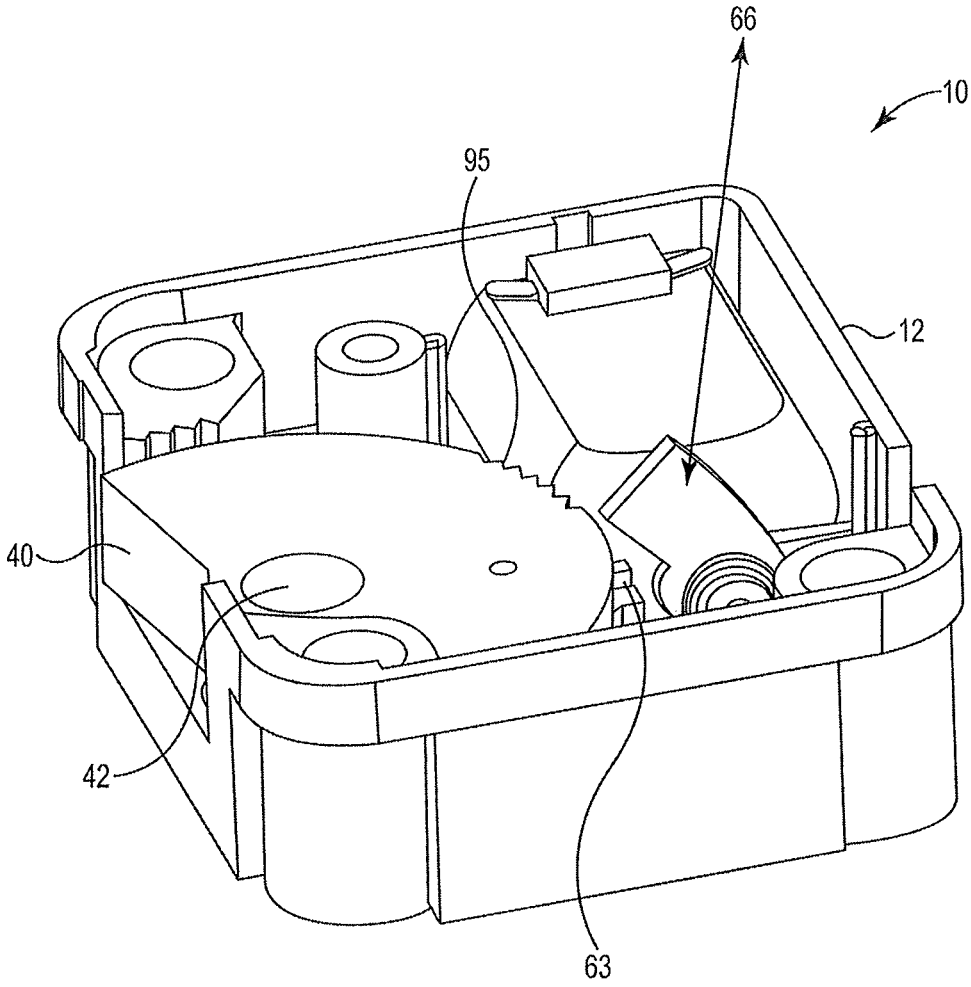
FIG. 3 is perspective view of one embodiment of a lock according to the invention.
Figure 4:
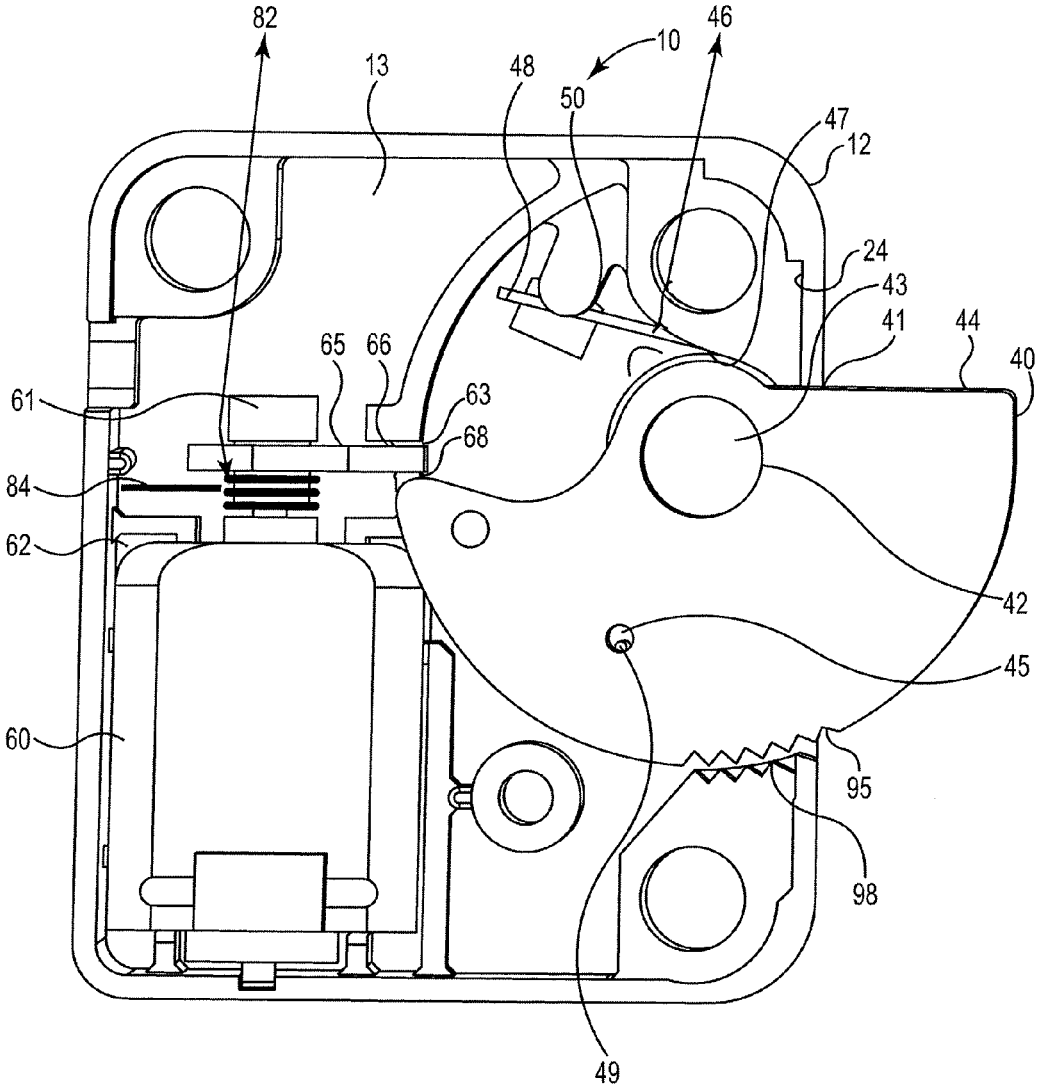
FIG. 4 is a top view of the lock of FIG. 3 illustrating a locking bolt in the locked position.
Figure 5:
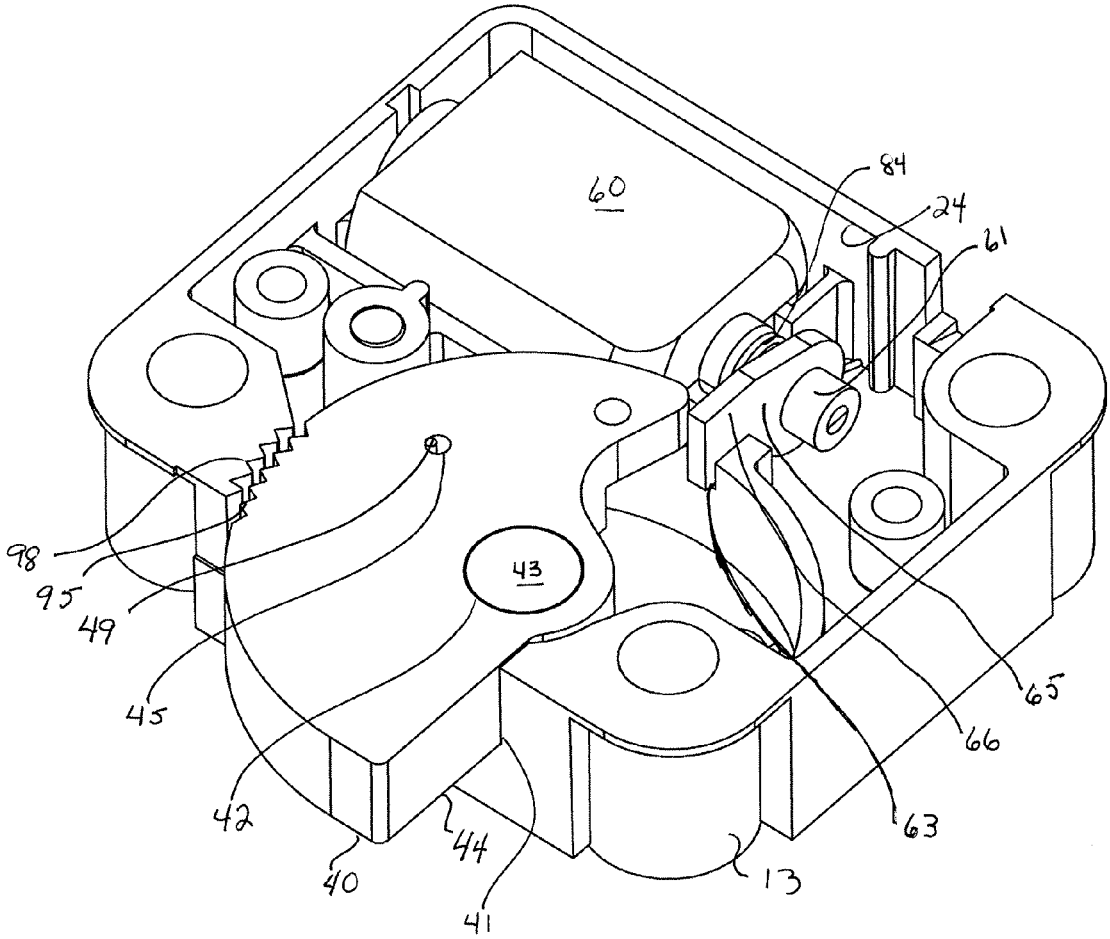
FIG. 5 is a perspective view of the lock in accordance with the invention showing the flange in the blocking position.
Figure 6:
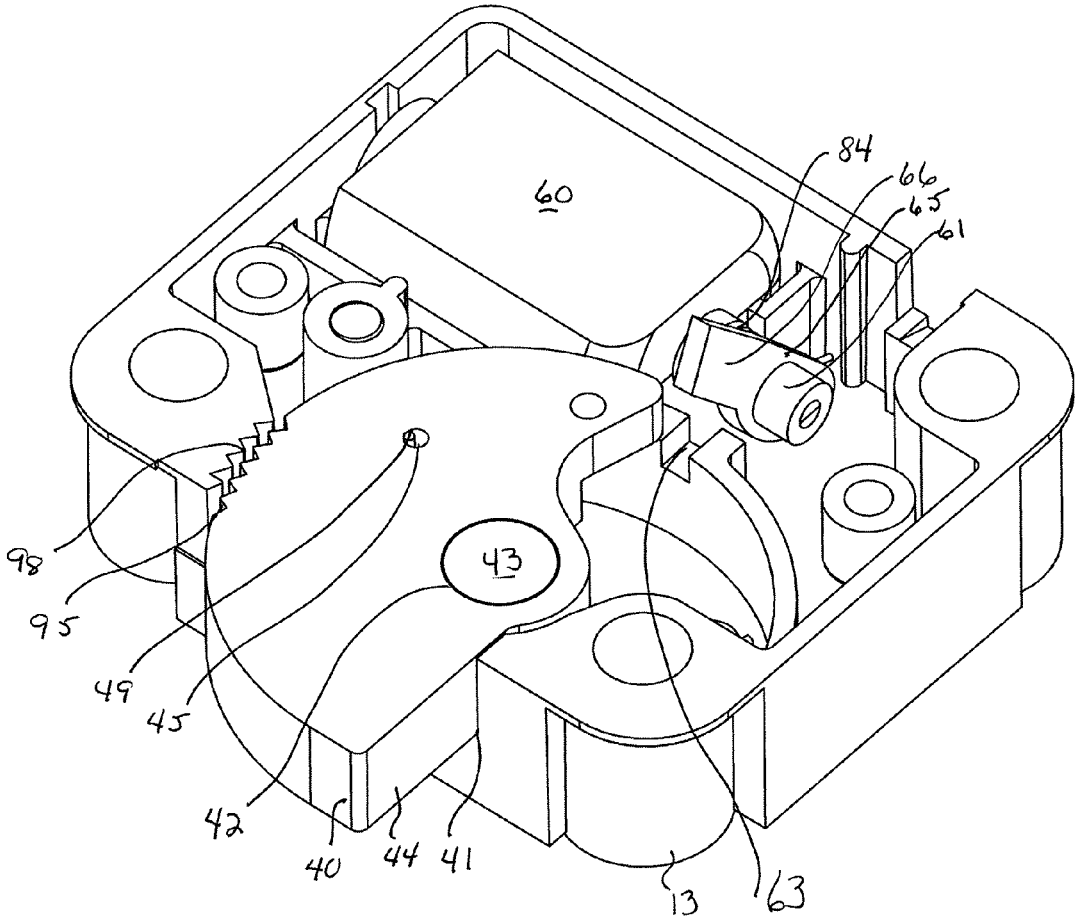
FIG. 6 is a perspective view of the lock in accordance with the invention showing the flange in the non-blocking position.

Locking bolt 40 is illustrated in FIGS. 1 and 4 in a locked position. In the locked position, extended portion 44 of locking bolt 40 extends outside locking bolt opening 46. Locking bolt opening 41 is an indentation in top wall 14 of housing 12 that is typically formed when the housing is cast. Cover 15 may have a narrow flange (not shown) that extends into and forms a boundary or wall of opening 41. In operation, locking bolt 40 rotates to an unlocked position in which extended portion 44 of locking bolt 40 retracts within housing 12. The movement of locking bolt 40 between the locked and unlocked positions will be described in more detail with reference to FIGS. 3 and 4.

Locking bolt 40 includes an aperture 45 therein. A bolt return spring 46 includes a central spring portion 47, a biasing portion 48 and a pin portion 49. The central spring portion 47 is positioned on and surrounds shaft 46. Biasing portion 48 stretches from central spring portion 47 and engages a shelf of housing 12 that extends upward from inside wall 24. Pin portion 49 stretches from the opposite end of central spring portion and is received by bolt aperture 45. Thus, tension from spring 46 biases locking bolt 40 counterclockwise with extended portion 44 of bolt 40 in the locked position.

An actuator 60 mounts inside housing 12. Many different types of actuators may be used including, but not limited to, motors, rotary solenoids, electromechanical rotary devices, and electromagnetic rotary devices. As an exemplary embodiment, actuator 60 will be described as a rotary solenoid throughout the remainder of this disclosure. As best seen in FIGS. 3 and 4, rotary solenoid 60 mounts in a cavity 62 within housing 12, which is formed by several walls extending upward from inside wall 24 of base 13. The walls forming cavity 62 are typically part of the casting that forms housing 12. Attached to rotary solenoid 60 via a rotary shaft 61 is a cam engagement means 65 including an elongated flange member 66 extending radially therefrom. Cam return spring 82 biases cam engagement means 65 in the "blocking" position 68 as shown in FIG. 4. Elongate flange member 66 engages a surface of locking bolt 40 to maintain the bolt 40 in the locked position. Circuitry within a circuit board (not shown) cooperates with the combination entry device discussed previously. When the user enters the correct combination, the circuitry signals solenoid 60 to rotate flange member 66 by a predetermined amount. As a result, the cam engagement means with flange member 66 rotates and disengages with locking bolt 40, allowing the bolt to rotate clockwise to the unlocked position.

Referring now to FIGS. 3 and 4, how rotary solenoid 60 controls movement of locking bolt 40 will now be described. Cam engagement means 65 includes a central portion having an opening therein that is mounted on a rotary shaft operably coupled to the output of rotary solenoid 60. Cam engagement means 65 also includes an elongate flange member 66 extending radially outward therefrom. In the blocking position, elongate flange member 66 is received with a groove or stop 63 in housing 12. Flange member engages a portion of locking bolt preventing it from moving into an unlocked position. Rotary solenoid 60 rotates cam engagement means 65 between a locked position where the tip of locking bolt engages the elongate flange member 68 and an unlocked position where the elongate flange member disengages the tip of locking bolt 40 allowing the locking bolt to bypass elongate flange member 66 and the locking bolt is able to freely rotate from the locked position as shown in FIG. 4 to the unlocked position as shown in FIG. 3.

As shown in FIG. 4, locking bolt 40 is in the locked position with bolt 40 extended outside housing 12. If the user fails to enter the correct combination or attempts to open the door without entering a combination, the elongate tab remains blocking locking bolt 40 so that locking bolt cannot freely move. Attempting to rotate the handle causes locking bolt 40 to push against elongate flange member 66. Tamper resistant mechanism 95, shown as teeth, prevents further rotation of locking bolt 40 even when additional pressure is exerted on the handle, as will be described in further detail to follow. An authorized user then will reenter the correct combination.

FIG. 3 is a perspective view of lock 10 illustrating locking bolt 40 rotated to the unlocked position. In particular, after entry of the correct combination, rotary solenoid 60 rotates cam engagement means such that elongate flange member 66 is no longer in engagement with locking bolt 40. Because there is no longer an interference between elongate flange member 66 and locking bolt 40, the bolt may rotate toward the unlocked position as illustrated in FIG. 3. In the unlocked position, extended portion 44 of locking bolt 40 rotates such that it is completely within housing 12.

As locking bolt 40 rotates clockwise toward the unlocked position, bolt return spring 46 creates a spring tension that urges locking bolt 40 in the counterclockwise direction. Thus spring 46 biases locking bolt 40 to return to the locked position when a user releases the handle (not shown).

Lock 10 also includes cam return spring 82 disposed between the cam engagement means and rotary solenoid 60. Spring 82 includes an arm 84 that rests on the inside of housing 12. When cam engagement means 65 rotates from the locked to the unlocked position, spring 82 creates a spring tension as would be appreciated by one skilled in the art. Thus, spring 82 biases cam engagement means 65 and elongate flange member 66 in the blocking position 68. When rotary solenoid 60 ceases to transmit a signal that allows locking bolt 40 to unlock by the mechanism described above, cam engagement means 65 and elongate flange member 66 will automatically return back to the locked position.

Referring now to FIG. 3, a top view of a portion of lock 10 in accordance with one embodiment of the present invention shows locking bolt 40 in the unlocked position. Locking bolt 40 has rotated clockwise about shaft 43 such that extended portion 44 of locking bolt 40 is disposed within housing 12. As locking bolt 40 rotates about shaft 43, the position of shaft 43 within rear sleeve 90 remains relatively constant (i.e., shaft 43 remains in the "normal" position) due to the force of compression of spring 94 on the outer surface of shaft 43. Therefore, as locking bolt 40 rotates toward the unlocked position, there is enough of a clearance between a plurality of teeth positioned in both locking bolt 40 and housing 12 to allow locking bolt 40 to rotate freely between the locked and unlocked positions without obstruction.

Referring again to FIG. 4, the "tamper-resistant" mechanism 95 of the present invention is shown. In particular, locking bolt 40 includes a plurality of teeth 95 that are configured to engage with mating teeth 98 in housing 12 positioned near locking bolt opening 46. In one embodiment, the clearance between teeth 95 and teeth 98 is between about 0.005 inches and about 0.015 inches. If a user attempts to force locking bolt 40 to the open position, a force F is applied through the handle of the bolt works (attached to the front of a container onto which the locking bolt 40 is mounted) on locking bolt 40. Because the correct combination has not been entered, elongate flange member 68 remains in contact with the tip of locking bolt 40 as shown in FIG. 4. The force from the handle applies a clockwise torque on locking bolt 40, which in turn causes a force to be exerted on shaft 43. The force exerted on shaft 43 is in the direction of the elongated portion of rear sleeve 90 and moves against the force produced by compression spring 94. As a result, shaft 43 compresses spring 94 and moves toward the right side of rear sleeve 90.

When the user attempts to force locking bolt 40 to the open position, locking bolt 40 moves to the right sufficiently so that teeth 95 of locking bolt 40 engage with teeth 98 in housing 12. Teeth 98 are generally formed as part of the cast brass housing 12, although workers skilled in the art will appreciate that the teeth may be formed from other materials and attached to housing 12. Furthermore, it becomes apparent that even if someone attempts to insert a thin piece of shim stock in between teeth 96 and 98 to "override" the tamper-resistant mechanism, the shim stock will deform as the teeth engage with one another.

When locking bolt teeth 95 engage housing teeth 98, locking bolt 40 is prevented from rotating clockwise. As FIG. 4 shows, locking bolt 40 remains in the locked position. This limits the force that locking bolt 40 applies on elongate flange member 68 which is in contact with locking bolt 40. Consequently, locking bolt 40 does not apply enough force to elongate flange member 68 to shear it off and therefore allow unauthorized access into the safe. A user attempting to force the lock can not rotate locking bolt 40 to the open position nor cause the bolt works to withdraw the safe locks to gain entry to the safe.

Although the present invention has been described with reference to preferred embodiments, workers skilled in the art will recognize that changes may be made in form and detail without departing from the spirit and scope of the invention.

I claim:

1. A lock comprising:

a housing defining a cavity, said housing including an opening for receiving a locking bolt, said cavity including a flange receiving slot therein, said locking bolt operably coupled to a shaft received by said cavity, said locking bolt movable between a locked position and an unlocked position, said locking bolt having a tip portion contained within said housing;

a locking bolt return spring received within said cavity and configured to bias said locking bolt in the locked position;

a rotary actuator having a rotary output;

a flange rotatably coupled to said rotary actuator, said flange energizable by said rotary actuator between a first blocking position in which a first portion of the flange is received by said flange receiving slot and a second portion of said flange contacts the locking bolt tip portion and blocks the locking bolt from moving into the unlocked position and a second non-blocking position in which the flange rotates out of said flange receiving slot and does not block the tip portion of the locking bolt to allow the locking bolt to by pass the flange and retract into said housing; and a flange spring including an elongate arm abutting a portion of said housing, said flange spring interposed between said rotary actuator and said flange wherein said arm biases the flange member in the blocking position.

2. The lock of claim 1, further including a tamper resistant mechanism comprising a plurality of teeth in the housing, the plurality of housing teeth configured to mate with a plurality of teeth on the locking bolt thereby limiting rotational movement of the locking bolt upon application of force to the locking bolt.

3. The lock of claim 2, wherein the lock includes a clearance between about 0.005 inches and about 0.015 inches between the teeth in the housing and the teeth in the rotary locking bolt.

4. The lock of claim 2, wherein the locking bolt is pivotally mounted to the shaft.

5. The lock of claim 1, wherein the locking bolt is a rotary locking bolt.

6. The lock of claim 1, wherein the rotary actuator is a rotary electromagnetic device.

7. The lock of claim 1 wherein said locking bolt return spring including a central spring portion, a biasing arm and a pin portion, said central spring portion received by said shaft and said pin portion received by said pin portion receiving aperture and said biasing arm received under said locking bolt return spring shelf, said biasing arm.

* * * * *